US008413381B2

(12) United States Patent
Theisen

(10) Patent No.: US 8,413,381 B2
(45) Date of Patent: Apr. 9, 2013

(54) HINGE

(75) Inventor: Martin Theisen, Troisdorf (DE)

(73) Assignee: KL-Beschlage Karl Loggen GmbH, Eitorf (DE)

( * ) Notice: Subject to any disclaimer, the term of this patent is extended or adjusted under 35 U.S.C. 154(b) by 0 days.

(21) Appl. No.: 12/811,179

(22) PCT Filed: Dec. 29, 2008

(86) PCT No.: PCT/EP2008/068332

§ 371 (c)(1),
(2), (4) Date: Jun. 29, 2010

(87) PCT Pub. No.: WO2009/083586

PCT Pub. Date: Jul. 9, 2009

(65) Prior Publication Data

US 2010/0319265 A1 Dec. 23, 2010

(30) Foreign Application Priority Data

Dec. 31, 2007 (DE) ..... 20 2007 018 220 U
Jun. 27, 2008 (DE) ..... 20 2008 008 507 U

(51) Int. Cl.
*E05D 7/08* (2006.01)
*E05D 11/00* (2006.01)
*E05D 7/00* (2006.01)

(52) U.S. Cl. ..... 49/397; 49/399; 16/254; 16/270

(58) Field of Classification Search ..... 49/381, 49/397, 398, 399, 400, 401; 16/254, 257, 16/270, 321, 334, 367, 368, 378
See application file for complete search history.

(56) References Cited

U.S. PATENT DOCUMENTS 2,904,819 A * 9/1959 Seaman ..... 16/50
3,965,532 A * 6/1976 Wigfall ..... 16/270
4,406,087 A * 9/1983 Asaka et al. ..... 49/70
(Continued)

FOREIGN PATENT DOCUMENTS

DE 20300089 U1 3/2003
EP 0875650 A2 11/1998
GB 1055483 1/1967

OTHER PUBLICATIONS

International Preliminary Report on Patentability for PCT/EP2008/068332 dated Aug. 10, 2010; 8 pages.

*Primary Examiner* — Katherine Mitchell
*Assistant Examiner* — Justin Rephann
(74) *Attorney, Agent, or Firm* — Hodgson Russ LLP

(57) ABSTRACT

The invention relates to a device having a component (1), in particular a door, and having a mounting unit (3), in particular a door frame. The invention is based on the object of providing a device that by the use thereof, the mounting of the component on the mounting unit is simplified, and which has a construction such that a good aesthetic impression can be achieved. For this purpose, the device has at least one component (1), at least one mounting unit (3), on which the component (1) can be mounted, and at least one fastening unit (4, 17), which is disposed on the component (1), wherein said fastening unit (17) has at least one first joint element (18) and at least one second joint element (19), wherein said fastening unit (17) is disposed articulated on the component (1) using said first joint element (18), and wherein said fastening unit (17) can be mounted articulated on said mounting unit (3) using said second joint element (19).

11 Claims, 5 Drawing Sheets

U.S. PATENT DOCUMENTS 4,748,718 A * 6/1988 Harrison ..... 16/254
4,754,524 A * 7/1988 Bullock et al. ..... 16/273
4,987,640 A * 1/1991 Lin ..... 16/327
4,996,740 A * 3/1991 Hales et al. ..... 16/378
5,008,975 A * 4/1991 Wang et al. ..... 16/266
5,052,079 A * 10/1991 Vosskotter ..... 16/367
5,412,842 A * 5/1995 Riblett ..... 16/334
5,483,770 A * 1/1996 Marinoni ..... 49/388
7,328,482 B2 * 2/2008 Elmer ..... 16/252
2004/0020011 A1 2/2004 Fang
2004/0206007 A1 10/2004 Chiang

* cited by examiner

Fig. 2
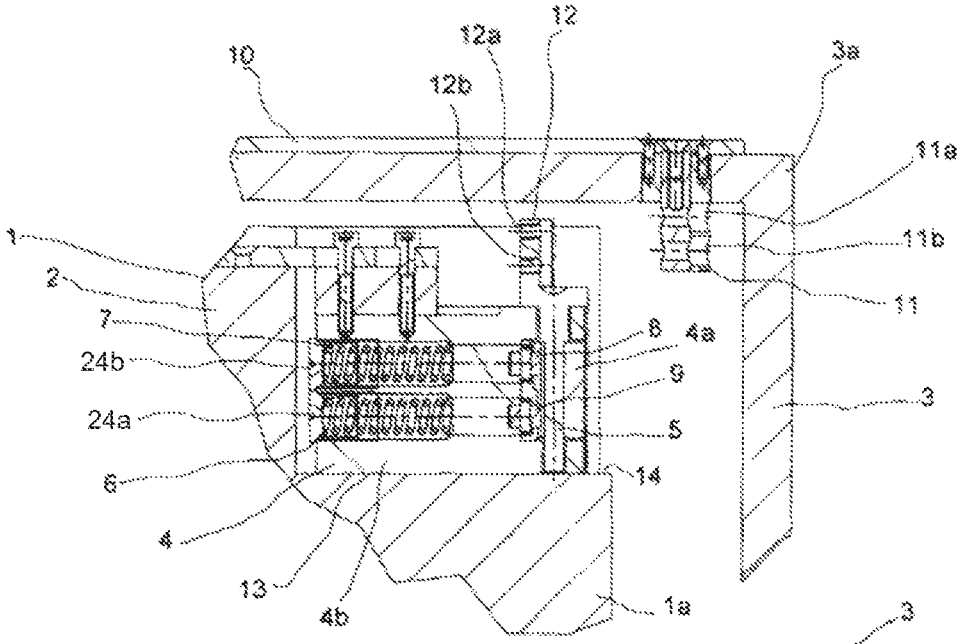
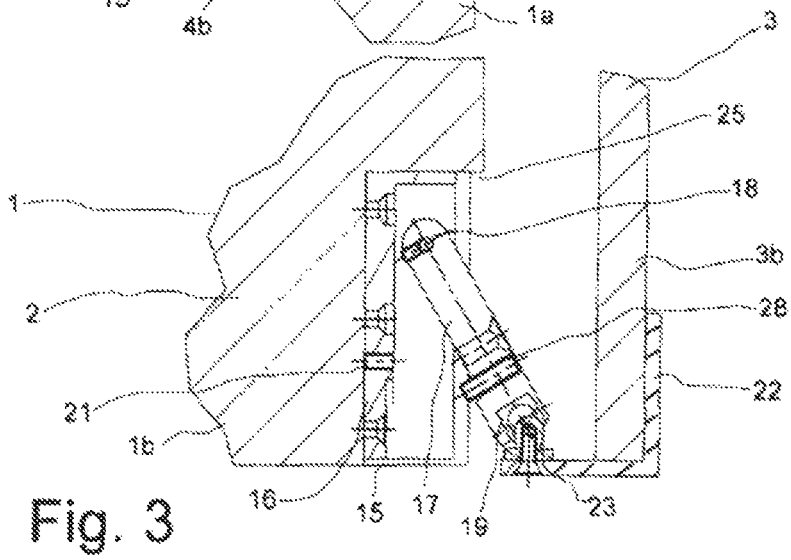
Fig. 3

Fig. 5
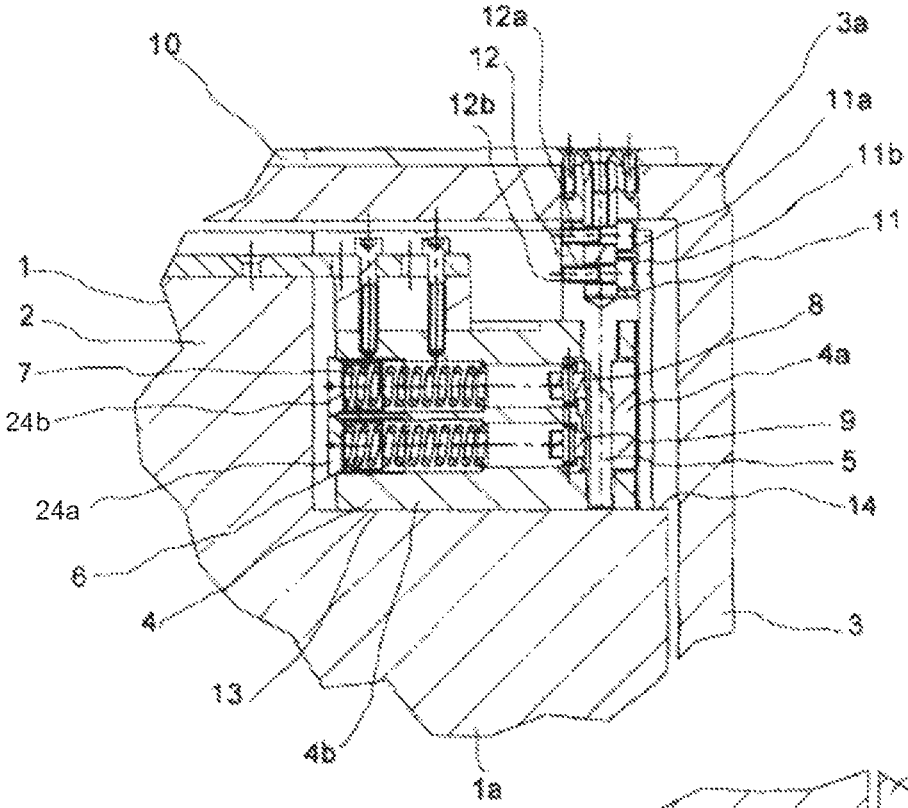
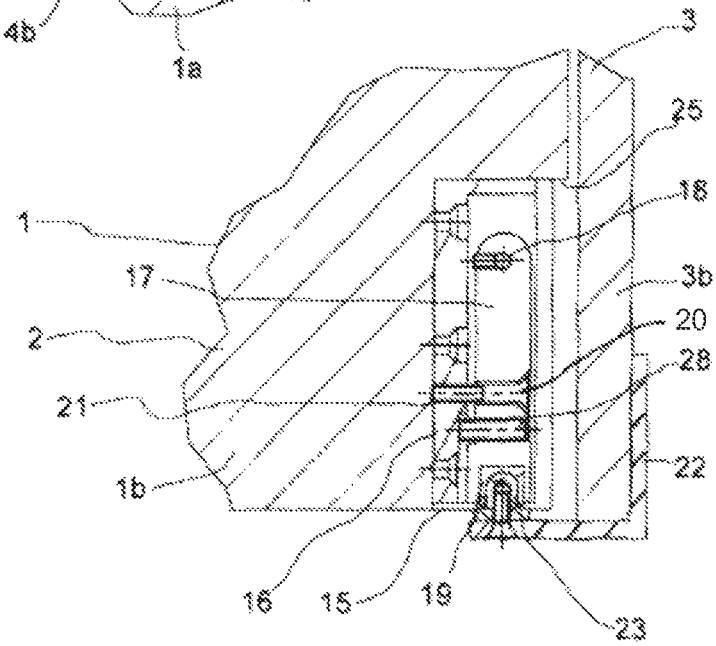
Fig. 6

HINGE

The invention concerns a device with a component, particularly a door, and with a mounting unit, particularly a door frame.

The state of the art has known a door for a long time which is arranged on a door frame by means of at least one articulated joint so that it can be opened in two opposing directions, thus performing a swinging motion. The door furthermore has a stationary position (also called zero position) in which the door closes a walkthrough opening. This type of door is called a swinging door.

The state of the art knows a swinging door that is made of glass. It is arranged on a door frame by means of two articulated joints placed at a distance from each other on the swinging glass door; the articulated joints clamp a glass plate that has the shape of a door leaf, between clamping plates.

The state of the art knows another swinging door that is made of wood. The door leaf of this swinging door is made of wood. An upper part of the door leaf has an articulated joint which allows movement in two opposing directions (swing movement), and a stationary position to close a walkthrough opening. The wooden swinging door is arranged on a door frame with the articulated joint and a pin seat in the lower part of the door leaf. But this known wooden swinging door has the disadvantage that the articulated joint is located in the upper part of the door leaf and is visible after the wooden swinging door is arranged on the door frame, which does not achieve a very aesthetic impression. The installation of the known wooden swinging door is also very costly because it must first be tilted about 45° so that a pin on the door frame can enter the pin seat, and the door must then again be placed into the vertical position for attachment to the door frame. Furthermore, two persons are often needed to attach the wooden swinging door.

The object of the invention is therefore to provide a device whereby the installation of a component (particularly a swinging door) on a mounting unit (particularly a door frame) is simplified and where the installation achieves a good aesthetic impression.

The invention fulfills this object with a device that comprises the features of claim 1. Other features of the invention can be found in the other claims, in the subsequent description and/or in the enclosed figures.

A device according to the invention comprises at least one component and at least one mounting unit on which the component can be arranged. The component for example is a door, particularly a swinging door, and the mounting unit is a door frame or a wall. In addition at least one attachment unit is arranged on the component. The attachment unit comprises at least a first joint element and at least a second joint element, where the attachment unit is arranged in articulated form on the component by means of the first joint element, and where the attachment unit is arranged in articulated form on the mounting unit by means of the second joint element.

The invention therefore has two articulated points for the attachment unit. The first joint element provides a first articulated point. This allows the attachment unit to pivot with respect to the component around this first articulated point. The second joint element also makes a second articulated point available. The attachment unit can therefore turn in relation to the mounting unit around this second articulated point.

The invention provides for the simple mounting of a component on a mounting unit (for example a door on a door frame). The articulated arrangement of the attachment unit on both the component and the mounting unit allows the component to be positioned upright so that it can be attached to the mounting unit. The component does not need to be tilted. The installation can also be carried out by a single person. Furthermore, the articulated arrangement makes it possible to install the attachment unit on the component so that it can be covered. It is therefore not visible. A viewer can then always believe that the component is made of a single piece. This achieves a good aesthetic impression.

One embodiment of the invention arranges for the device to include at least one attachment element arranged on the mounting unit. The attachment element is designed for example to receive the attachment unit for installing the component on the mounting unit. The attachment unit and the attachment element therefore serve to install the component on the mounting unit. The second joint element is used to install the attachment unit to turn in relation to the attachment element.

Furthermore the device of the invention preferably comprises at least one cover element to cover the attachment unit. The cover element is made of the same material as the component for example, so that a uniform total impression is achieved when looking at the component with its cover element installed. If the component is a wooden swinging door, the above preferred embodiment provides the cover element to be made of the same wood. Another embodiment provides for the attachment unit to be embedded in the component which contains a seat into which the cover element is placed so that it is flush with the component. This creates an especially good aesthetic impression.

Another preferred embodiment of the invention comprises at least two attachment units, namely a first attachment unit and a second attachment unit. The first attachment unit as well as the second attachment unit are arranged on the component. The second attachment unit also comprises the first joint element and the second joint element. It is preferred that the first attachment unit is arranged in an upper area of a door-shaped component, while the second attachment unit is arranged in a lower area of the door-shaped component. It is further preferred to install at least two attachment elements on the mounting unit, namely a first attachment element and a second attachment element, where the first attachment element is allocated to the first attachment unit, and the second attachment element is allocated to the second attachment unit. The second attachment unit uses the first joint element for its articulated installation on the component. Beyond that the second attachment unit can be arranged in articulated form on the second attachment element by means of the second joint element. This type of embodiment is therefore a system with two attachment units, where the first unit is preferably designed as a articulated joint to enable the component to turn, and the second unit is especially designed for a simple installation of the component on the mounting unit.

The invention furthermore comprises at least two cover elements, namely a first cover element and a second cover element, where the first one covers the first attachment unit and the second one covers the second attachment unit. It is also preferred for the first attachment unit to be embedded in the component which comprises a first seat where the first cover element is arranged so that it is flush with the component. This achieves an especially good aesthetic impression of the component on the mounting unit. In addition or as an alternative thereto, the second attachment unit is embedded in the component which comprises a second seat where the second cover element is arranged so that it is flush with the component. An alternative embodiment has a single cover element for both the first and the second attachment units. It extends for example over the entire length of the component and is preferably installed by means of a clip attachment.

In an alternative embodiment of the invention, the first attachment unit of the invented device comprises at least a third joint element and at least a fourth joint element, where the first attachment unit uses the third joint element for an articulated arrangement on the component, and where the first attachment unit can be arranged in articulated form on the first attachment element by using the fourth joint element. Thus the first attachment unit can have the same arrangement as the second attachment unit in addition to or as an alternative to it.

The device of the invention is preferably designed so that the component can turn in relation to the mounting unit around a turning axis. If the component for example is a door, especially a swinging door, it is designed to turn in relation to a mounting unit in the form of a door frame or a wall. If the device is only equipped with a single attachment unit, it is preferable for the first joint element to have a articulation axis around which the attachment unit can turn, and be arranged vertically in relation to the articulation axis. In case the device of the invention is equipped with the first and the second attachment unit, the first joint element comprises an articulation axis around which the second attachment unit can turn, and the articulation axis is vertical with respect to the turning axis. As an alternative or in addition thereto, the third joint element comprises an articulation axis around which the first attachment unit can turn, and said articulation axis is vertical with respect to the turning axis.

Another preferred embodiment of the invention has a mounting block arranged on the component and allows the one attachment unit or the second attachment unit to be arranged in articulated form by means of the first joint element. In particular it is provided that the mounting block be fully embedded in the component so that it is not visible from the outside (possibly by using a cover element). This type of embodiment promotes the goal of installing the one attachment unit or the second attachment unit so that it is not visible from the outside.

It is preferred that the invented device comprises a second joint element which has a first part of a first ball-headed joint, and for the mounting unit to include a second part of the first ball-headed joint. It is provided in particular that the second part of the first ball-headed joint is formed on the second attachment element. As an alternative or an addition thereto, the fourth joint element comprises a first part of a second ball-headed joint, and the mounting unit comprises a second part of the second ball-headed joint. This embodiment especially provides that the second part of the second ball-headed joint is formed on the first attachment element. The formation of the second or the fourth joint element as a ball-headed joint or a part thereof is especially advantageous because it greatly simplifies the installation of the one attachment unit or the second attachment unit on the mounting unit. In addition it makes possible a controlled movement of the component in all directions so that a secure installation of the component on the mounting unit can take place.

Another preferred embodiment of the invention provides that the first attachment unit is an articulated joint. As already mentioned earlier, the articulated joint can be especially designed for a swinging door, thereby ensuring that it can perform a turning movement to create open positions in opposite directions. But the invention is not restricted to a swinging door. The component can also be designed for example as a stopping door (namely a door that only opens in one direction and abuts against a stop in the resting position).

The preferred articulated joint of the device in the invention has a latching mechanism inside the articulated joint, which consists of at least one latch part that can move against a spring, and at least one latch recess into which the latch part fits in a springy manner when it is in the resting position. Several latch situations are preferably provided. In one latch situation the component, for example the door, is in a closed position and thereby closes a walkthrough opening. In another latch situation the component is in an open position so that the walkthrough opening is accessible. Another latch situation can also be provided, where the component is also in an open position, but which differs from the already described open position. This type of embodiment is of special advantage with a swinging door. The individual latch situations are preferably adjustable.

In another embodiment of the invention the first attachment element is designed as a rail which is arranged on the mounting unit and comprises at least one adapter part. The adapter part is designed to be connected to a corresponding adapter counterpart of the first attachment unit. It is furthermore preferred if the second attachment element is an elbow part.

As already mentioned several times earlier, a special embodiment of the invention provides for the component to be a door, particular a swinging door, and for the mounting unit to be designed as a door frame. However the mounting unit can be in any form, it can be a wall for example. It is furthermore preferred that the mounting unit at least partially surrounds the component. Another embodiment provides for the door to have a door leaf and for the joint axis to be vertical to a door leaf plane. Once again it is clearly pointed out that the invention is not restricted only to a component in the form of a door, particularly a swinging door. Rather the invention is suitable for any component that is to be arranged on a mounting unit.

The invention will be explained in greater detail in the following by means of an embodiment example which uses figures, where:

FIG. 2 is a detail drawing of the area A in FIG. 1.

FIG. 3 is a detail drawing of the area B in FIG. 1.

FIG. 5 is a detail drawing of the area C in FIG. 4, but without a cover element;

FIG. 6 is a detail drawing of the area D in FIG. 4, but without a cover element.

Figure 1:
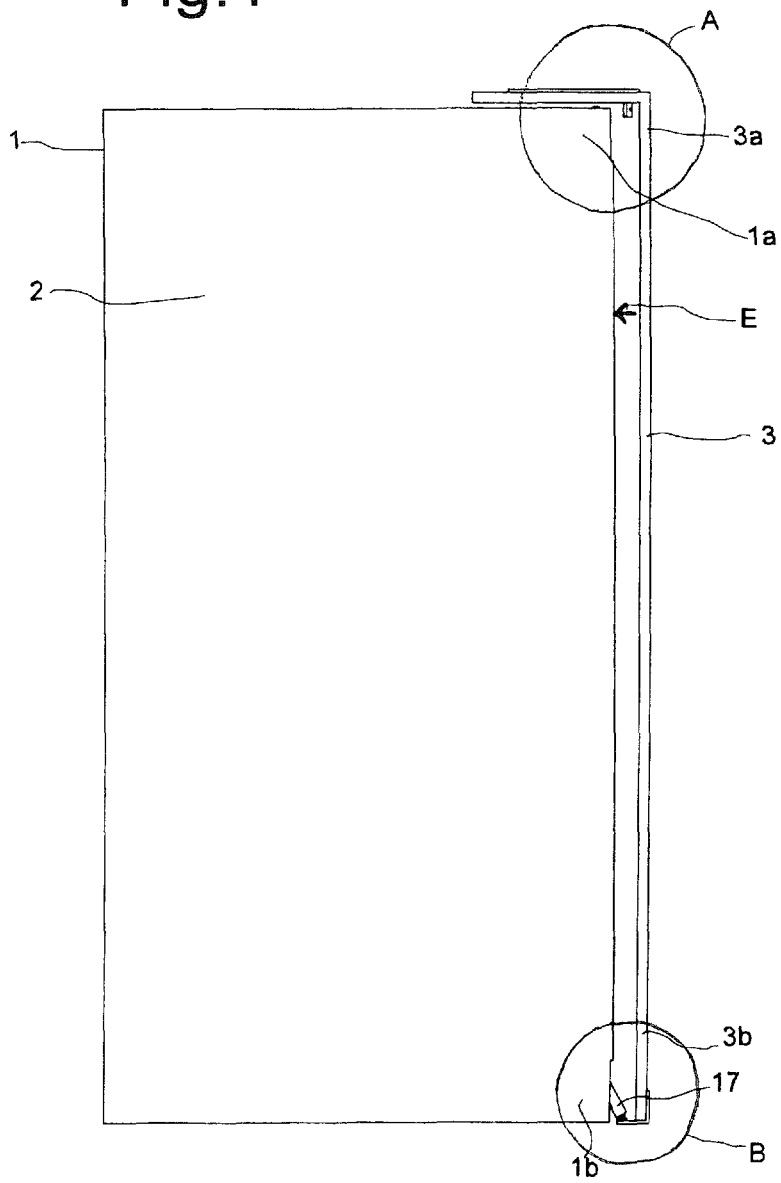
FIG. 1 is a schematic drawing of a wooden swinging door before it is arranged on a door frame.

FIG. 1 is a schematic drawing of a wooden swinging door 1 designed for installation on a door frame 3, but not yet arranged on said door frame 3. The swinging door 1 contains a door leaf 2, with an upper section 1*a* that faces a ceiling (not shown), and a lower section 1*b* that faces a floor (not shown). The upper section 1*a* is assigned to an upper section 3*a* of the door frame 3 while the lower section 1*b* is assigned to a lower section 3*b* of the door frame 3.

FIG. 2 is a detail drawing of the area A in FIG. 1. The drawing is a sectional view of the area A. The door leaf 2 of the swinging door 1 contains a recess 13 which can only be accessed in the direction of arrow E (FIG. 1) and which is only visible in that direction. The recess 13 contains a first attachment unit 4 in the form of an articulated joint secured with a screw connection, where the first attachment unit 4 is suitable for the movements of a swinging door. The first attachment unit 4 contains a first hinge part 4*a* and a second hinge part 4*b* which can turn in relation to each other around an axis 5. This ensures that the swinging door 1 is articulated in relation to the door frame 3.

A latching mechanism is located inside the first attachment unit 4. Thus three latch recesses (not shown) are located in the first hinge part 4*a*, namely a first latch recess, a second latch recess and a third latch recess. First latch part 8 and second latch part 9 are located in the second hinge part 4*b*. First latch part 8 is able to move against the action of a second spring 7. However second latch part 9 is able to move against the action of a first spring 6. Each of the first and second springs 6 and 7 has two ends, where one end abuts against the first or second latch part 8 or 9 and the other end abuts against a first or second adjusting screw 24*a* or 24*b* which is used to adjust the force against the first or second latch part 8 or 9.

In the latched position, first and second latch parts 8 and 9 enter into the first, second and/or third latch recess. The first latch recess is designed so that the swinging door 1 is in a closed position. The second latch recess is designed so that the swinging door 1 adopts a first open position when it reaches there, which is obtained by moving the swinging door 1 out of the leaf plane in FIG. 1. In contrast thereto, the third latch recess is located so that the swinging door 1 adopts a second open position when it reaches there, which is obtained by moving the swinging door 1 into the leaf plane in FIG. 1. The positions of the latch recesses are adjustable. In the depicted device this is also a self-closer. This means that in a certain angle position of door leaf 2 the latter is automatically placed in the closed position.

Figure 4:
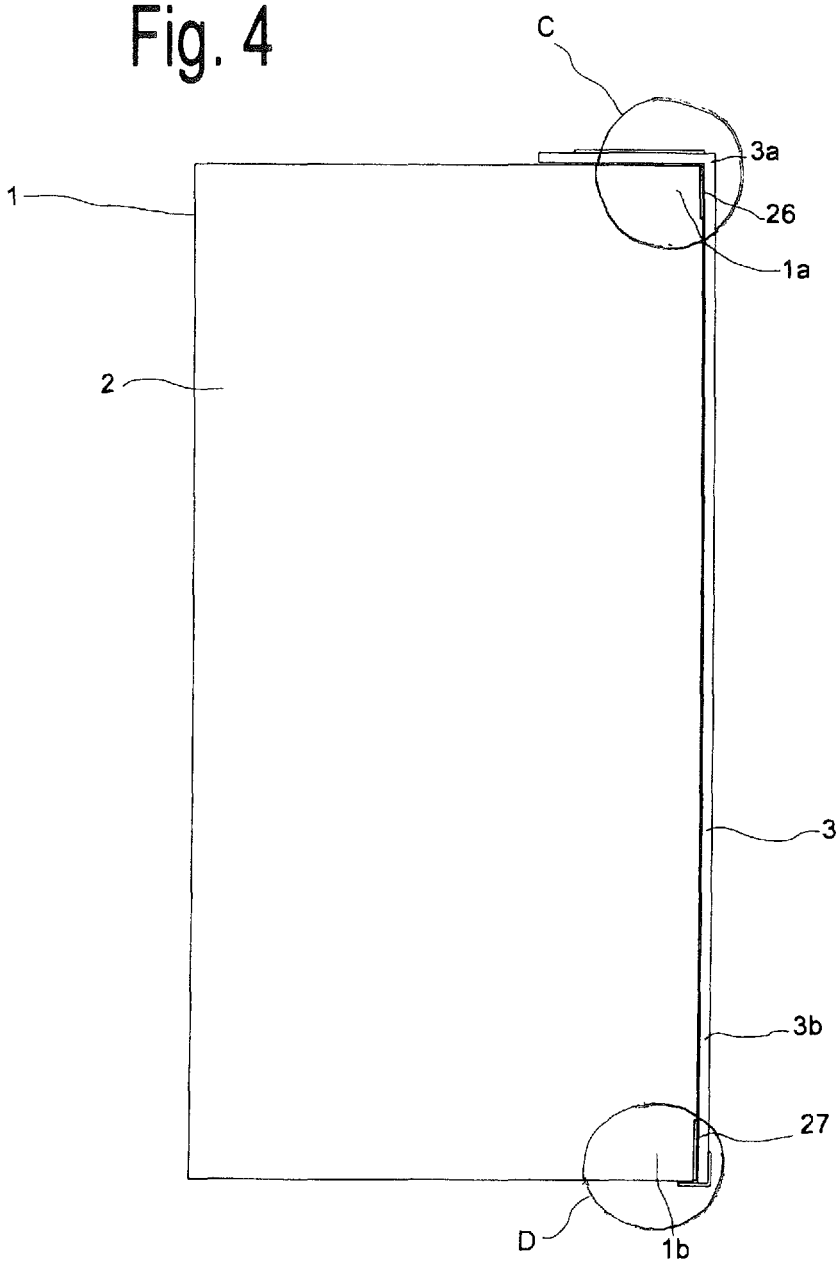
FIG. 4 is a schematic drawing of the swinging door in FIG. 1 after its installation on the door frame.

A first seat 14 is located in the area of the first hinge part 4*a* and basically represents a shoulder. The first seat 14 comprises a cover element 26 (see FIG. 4) which closes the recess 13 in the direction of the arrow E (see FIG. 1). The cover element 26 is made of the same material as the door leaf 2 in order to maintain a uniform picture. It is furthermore built so that it closes flush with the door leaf 2.

An alternative to the production from the same material is provided by other embodiments of the invention, in which the cover element 26 is made of a different material than the door leaf 2, for example of a plastic, but one that can have the same color as door leaf 2.

Figure 7:
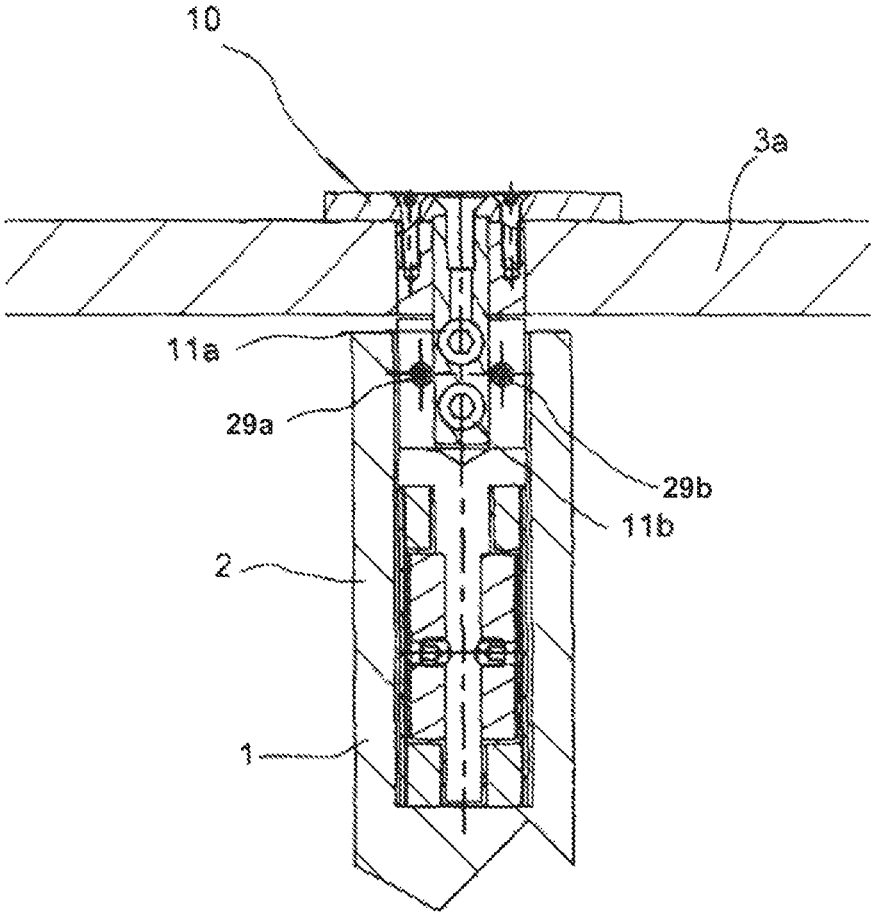
FIG. 7 is a side view of an adjusting device.

The upper section 3*a* of the door frame 3 comprises a first attachment element 10 in the form of a rail arranged on the door frame 3. An adapter part 11 of the first attachment element 10 passes through an opening in the door frame 3. The adapter part 11 has through-holes 11*a* and 11*b*. The adapter part 11 is designed to fit tightly on an adapter counterpart 12 which is located on the first hinge part 4*a* of the first attachment unit 4. The adapter counterpart 12 also contains threads 12*a* and 12*b*, which are flush with the through holes 11*a* and 11*b* when the adapter part 11 is placed on the adapter counterpart 12 so that the attachment screws can be inserted. Furthermore first and second stud screws 29*a* and 29*b* are provided on the adapter part 11, whereby a relative positioning of the attachment unit 4 on the door frame 3 is made possible (see FIG. 7).

FIG. 3 is a detail drawing of the area B in FIG. 1 and is a sectional view of said area B. The lower part 1*b* of the door leaf 2 of the swinging door 1 has a recess 15 which is only accessible and visible in the direction of the arrow E (see FIG. 1). The recess 15 has a U-shaped mounting block 16 that is solidly attached to it. A second attachment unit 17 is located between the two arms of the U-shaped form. The second attachment unit 17 has two ends, where one end has a first joint element 18 that is attached to it and a second end has an second joint element 19 that is attached to it. The first joint element 18 links the second attachment unit 17 in articulated form to the mounting block 16 or the door leaf 2. It is therefore able to turn in the plane of door leaf 2 around an axis provided by the second joint element 18 (sic), where the axis is vertical with respect to the turning axis around which the swinging door 1 can turn in relation to the door frame 3.

The second joint element 19 is designed to connect the second attachment unit 17 to the door frame 3. The lower part 3*b* of the door frame 3 has a second attachment element 22 in the form of an elbow, one end of which comprises a ball-headed link 23. The joint element 19 has an opening that corresponds to the ball-headed link 23, so that the ball-headed link 23 of the second attachment element 22 and the respective opening of the second joint element 19 can form a ball-headed joint.

The recess 15 is equipped with a second seat 25. A cover element 27 is located in the second seat 25 (see FIG. 4) which closes off the recess 15 in the direction of the arrow E (see FIG. 1). The cover element 27 is made of the same material as the door leaf 2 and closes it flush to preserve a uniform picture. An alternative to the production of the same material is provided by other embodiments of the invention in which the cover element 27 is made of a different material than the door leaf 2, for example a plastic but one that can have the same color as the door leaf 2.

To connect the swinging door 1 to the door frame 3 as shown in FIGS. 1 and 3, the second attachment unit 17 can first be swung about 30 to 45 so that the second attachment unit 17 protrudes from the door leaf 2 of the swinging door 1. After that the second joint element 19 is connected to the ball-headed link 23 of the second attachment element 22. The corresponding opening of the second joint element 19 and the ball-headed link 23 of the second attachment element 22 then form the ball-headed joint which makes it possible to move the swinging door 1 or the door leaf 2 in every direction. The swinging door 1 is then pushed against the door frame 3 so that the adapter part 11 of the first attachment element 10 is placed against the adapter counterpart 12 of the first hinge part 4*a* in the first attachment unit 4. The approach and relative positioning of the adapter counterpart 12 on the adapter part 11 is simple and precise because of the above described ball-headed joint and the thereby obtained degree of freedom of movement for the door leaf 2 in the swinging door 1. When the adapter counterpart 12 is advanced and positioned in relation to the adapter part 11, the door leaf 2 of the swinging door 1 moves in a way so that the second attachment element 17 is swung in the direction of the door leaf 2 and then adopts a vertical position (see FIGS. 4 and 6). The adapter part 11 is then attached to the adapter counterpart 12 by means of the screws inserted through the holes 11*a* and 11*b* into the threads 12*a* and 12*b* (see FIG. 5). The second attachment element 17 is securely fastened to the mounting block 16 by inserting a screw into a through hole in the second attachment element 17, which is aligned with a thread 21 in the mounting block 16 (see FIG. 6).

As already known from the state of the art, an adjustment of the zero position of the first attachment unit 4, and thus of the closed position, then takes place. A further fine adjustment of the distance of the door leaf 2 from the door frame 3 can be obtained by means of an adjusting screw 28, which is located in the second attachment element 17 where one of its ends abuts against the mounting block 16. Moving the first and second adjusting screw 24*a* and 24*b* moves the second attachment unit 17 a little in relation to the door leaf 2. To that end the screw in thread 21 may have to be loosened.

The invention ensures a simple mounting of the swinging door 1 on the door frame 3. The articulated arrangement of the second attachment unit 17 on both the swinging door 1 as well as on the door frame 3 allows the swinging door 1 to be placed in an upright position against the door frame 3, so that the swinging door 1 can be attached to the door frame 3. The approach, the positioning and the attachment of the swinging door 1 can then be carried out by a single person. The invention further ensures that the first attachment unit 4 and the second attachment unit 17 can be covered. They are then no longer visible. An observer therefore always believes that the swinging door 1 is made of a single piece. This leads to a desired good aesthetic impression.

LIST OF REFERENCE NUMBERS

1 Door (swinging door)
1*a* Upper section of the door
1*b* Lower section of the door
2 Door leaf
3 Door frame
3*a* Upper section of the door frame
3*b* Lower section of the door frame
4 First attachment unit (articulated joint)
4*a* First hinge part
4*b* Second hinge part
5 Axis
6 Spring
7 Spring
8 Latch part
9 Latch part
10 First attachment element
11 Adapter part
11*a* Through-hole
11*b* Through-hole
12 Adapter counterpart
12*a* Thread
12*b* Thread
13 Recess
14 Seat
15 Recess
16 Mounting block
17 Second attachment unit
18 First joint element
19 Second joint element
20 Drilled hole
21 Thread
22 Second attachment element
23 Ball-headed link
24 Adjusting screw
25 Seat
26 Cover element
27 Cover element
28 Adjusting screw
29 Stud screw

The invention claimed is:

1. An entrance system with at least one door, at least one mounting unit which is one of a door frame or a wall;

at least one first attachment unit in the form of a hinge, wherein the hinge is attached to the at least one door and the at least one mounting unit;

at least one second attachment unit which is attached to the at least one door;

wherein the at least one second attachment unit comprises at least one first joint element and at least one second joint element, wherein the at least one second attachment unit is articulatedly attached to the at least one door using the at least one first joint element, and wherein the at least one second attachment unit is articulatedly arranged on the at least one mounting unit using the at least one second joint element, the at least one door is rotatable in relation to the at least one mounting unit around a turning axis, the at least one first joint element comprises an articulation axis around which the at least one second attachment unit is rotatable, and the articulation axis is substantially perpendicular to the turning axis.

2. The entrance system as claimed in claim 1, wherein the entrance system comprises at least two cover elements, namely a first cover element and a second cover element, wherein the first cover element covers the hinge, and wherein the second cover element covers the at least one second attachment unit.

3. The entrance system as claimed in claim 2, wherein the hinge is embedded in the at least one door and the at least one door comprises a first seat on which the first cover element is arranged so that the first cover element is flush with the at least one door.

4. The entrance system as claimed in claim 2, wherein the at least one second attachment unit is embedded in the at least one door and that the at least one door comprises a second seat on which the second cover element is arranged so that it is flush with the at least one door.

5. The entrance system claimed in claim 1, wherein a mounting block is arranged on the at least one door on which the at least one second attachment unit is articulated using the at least one first joint element.

6. The entrance system as claimed in claim 1, wherein the at least one second joint element comprises a first part of a ball-headed joint, and that the at least one mounting unit comprises a second part of the ball-headed joint.

7. The entrance system as claimed in claim 6, wherein the second part of the ball-headed joint is formed on the at least one mounting unit.

8. The entrance system as claimed in claim 1, wherein a first attachment element is arranged at the at least one mounting unit, wherein the first attachment element is a rail, on which at least one adapter part is located.

9. The entrance system as claimed in claim 1, wherein a second attachment element is arranged at the at least one mounting unit and is an elbow.

10. The entrance system as claimed in claim 1, wherein the at least one door is a swinging door.

11. The entrance system as claimed in claim 1, wherein the at least one door comprises a door leaf and that the articulation axis is substantially perpendicular to a plane of the door leaf.

* * * * *

UNITED STATES PATENT AND TRADEMARK OFFICE

CERTIFICATE OF CORRECTION

PATENT NO. : 8,413,381 B2
APPLICATION NO. : 12/811179
DATED : April 9, 2013
INVENTOR(S) : Theisen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 118 days.

Signed and Sealed this
Fifth Day of November, 2013

Teresa Stanek Rea

Teresa Stanek Rea
*Deputy Director of the United States Patent and Trademark Office*